United States Patent [19]

Garcez

[11] Patent Number: 4,718,502

[45] Date of Patent: Jan. 12, 1988

[54] REPLACEMENT HANDLE FOR A JACKHAMMER

[76] Inventor: Lorenzo T. Garcez, 631 N. San Ignacio, San Antonio, Tex. 78228

[21] Appl. No.: 868,465

[22] Filed: May 30, 1986

[51] Int. Cl.[4] ..... B25D 17/04; B25G 3/24

[52] U.S. Cl. ..... 173/171; 16/111 R; 16/DIG. 24; 81/489

[58] Field of Search ..... 173/171, 170, 162 H; 81/489, 492; 16/DIG. 12, DIG. 18, DIG. 24, DIG. 41, 111 R, 114 R

[56] References Cited

U.S. PATENT DOCUMENTS

| | | | |
|---|---|---|---|
| 1,039,971 | 10/1912 | Leyner | 173/171 |
| 1,162,896 | 12/1915 | Achberger | 16/DIG. 12 |
| 2,456,267 | 12/1948 | Gazda | 16/111 R |
| 3,045,648 | 7/1962 | Belau et al. | 173/170 |

FOREIGN PATENT DOCUMENTS

| | | | |
|---|---|---|---|
| 649733 | 6/1985 | Switzerland | 173/171 |

*Primary Examiner*—E. R. Kazenske
*Assistant Examiner*—Hien H. Phan
*Attorney, Agent, or Firm*—Henderson & Sturm

[57] ABSTRACT

A typical jackhammer has a pair of handles arranged in line normal to but at opposite sides of the vertical centerline of the elongated jackhammer body. Frequently one of these handles breaks off and renders the tool inoperative. The present invention provides a simple replacement handle that is easily installed in substitution for the broken-off handle, comprising a Y-shaped steel plate in which the arms of the "Y" bolt to the jackhammer body and the leg of the "Y" projects outwardly in line with and in opposition to the remaining handle. The leg of the "Y" is fitted with additional metal portions to give the leg a rounded section that closely simulates the original handle. Thus bolted in place, the replacement handle substantially restores the tool to operative condition.

7 Claims, 6 Drawing Figures

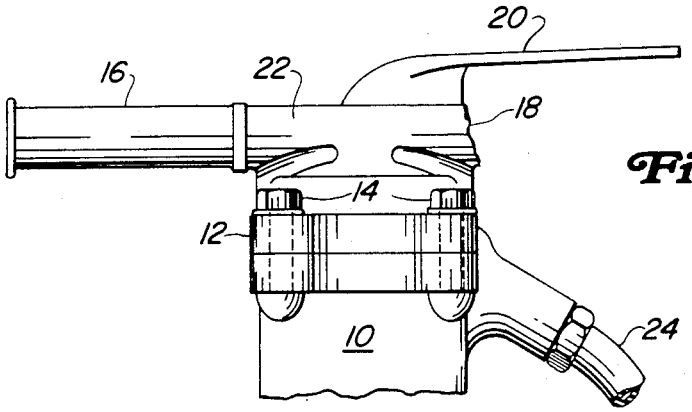
Fig. 1
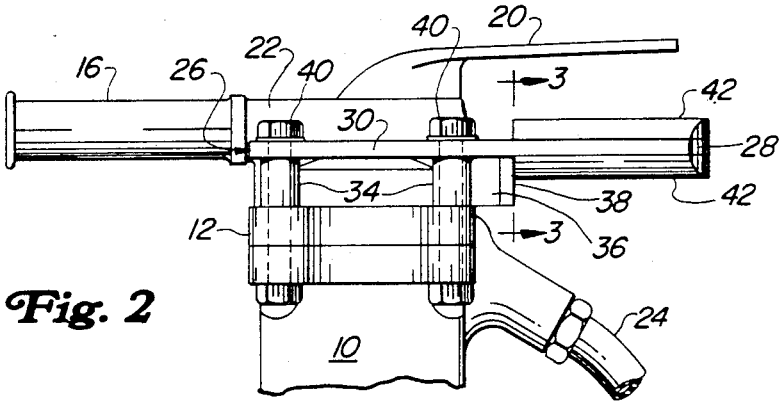
Fig. 2
Fig. 3
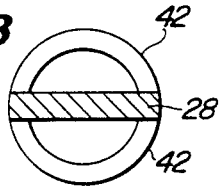
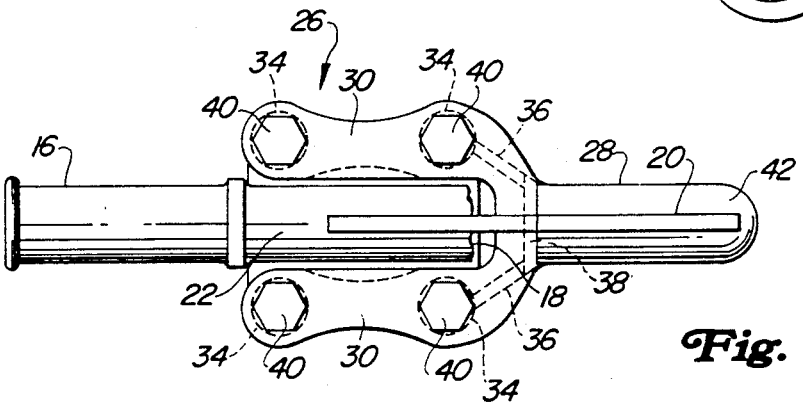
Fig. 4

REPLACEMENT HANDLE FOR A JACKHAMMER

BACKGROUND AND SUMMARY

The typical jackhammer is pneumatically operated in heavy-duty situations such as breaking up concrete, etc. and is therefore subject to extremely hard usage. In many instances, at least one of the two handles that are conventionally grasped by the workman breaks off because of the vibration and other rough handling. The tool cannot be operated with but one handle and, in the past, is repairable only by substitution of a new head having two handles, an expensive and time-consuming procedure.

According to the present invention, a replacement handle is provided that is simple, inexpensive and easy to install. It comprises, essentially, a Y-shaped element of one-half-inch steel plate, having two arms and a leg. In the usual jackhammer, four bolts or cap screws hold the upper head, including the original handles, to the main body. When one handle breaks off, the Y-shaped element is positioned with its arms straddling the raised mid-portion of the head and the leg projecting outwardly in line with the remaining handle. The original cap screws are removed and replaced with longer cap screws in order to accommodate the vertical spacers welded to the Y-shaped plate in order to dispose the leg of that plate substantially at the level of the remaining handle.

It is a further feature of the invention that the leg of the plate is supplemented at its top and bottom with complementary steel parts of substantially semicircular section so that, when the leg is sandwiched between these parts, the completed replacement handle is of rounded section substantially matching the remaining handle. Still further, the replacement handle has welded-in gussets secured to two of the spacers, thus adding further rigidity to the handle to contribute to its long life. Should the remaining handle break off, it may be similarly replaced.

Other features and advantages will become apparent as a preferred embodiment of the invention is disclosed in the ensuing description and accompanying drawings.

DESCRIPTION OF THE DRAWINGS

FIG. 1 is a view of the upper portion of a jackhammer with one handle in place and the other broken off.

FIG. 2 is a similar view but showing the replacement handle installed.

FIG. 3 is a section on the line 3—3 of FIG. 2.

FIG. 4 is a plan view of the structure shown in FIG. 2.

DETAILED DESCRIPTION OF A PREFERRED EMBODIMENT OF THE INVENTION

Figure 5:
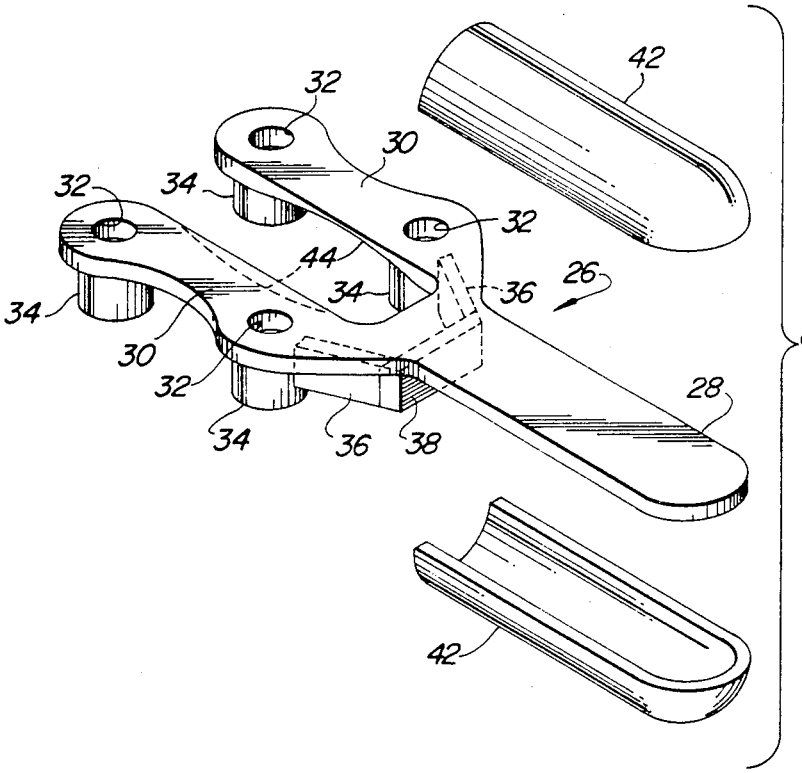
FIG. 5 is an "exploded" perspective of the parts of the replacement handle.

Those skilled in the art will recognize in the drawings a typical jackhammer having a vertically elongated body (10) to which a head (12) is rigidly attached by a plurality of cap screws (14) (usually four in number). The head carries rigidly thereon a pair of aligned handles, only one of which is shown at (16), the other having broken off as suggested by the stub (18). A typical control lever (20) extends outwardly over the original site of the broken off handle. Also typically, the head has a central raised portion (22) from which the missing handle has broken off at the stub (18). Air supply is furnished via a hose (24) as usual.

Figure 6:
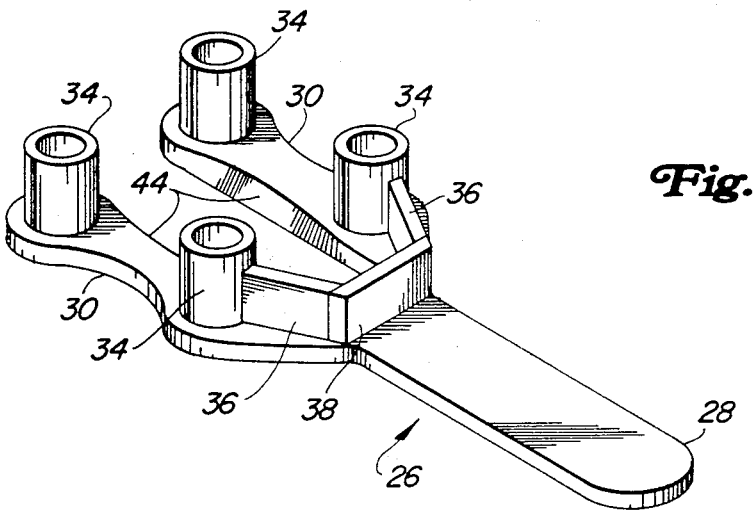
FIG. 6 is a part-assembled perspective of the handle as seen from its underside.

The replacement handle is best shown in FIGS. 5 and 6 apart from its assembly to the jackhammer head. It comprises a Y-shaped element (26), preferably of half-inch steel plate, having a leg (28) and a pair of arms (30), all coplanar. Each arm has a pair of openings (32), and the four openings are arranged to register respectively with openings in the head and body of the jackhammer that occur when the original cap screws (14) are removed, as will appear presently. As seen, the leg is dimensioned according to the remaining handle as to length, width, etc. The plate has welded to its underside four tubular steel spacers (34). The two spacers closer to the leg (28) are further joined to the plate by means of welded side gussets (36), and a central cross gusset (38), all of which add materially to the strength of the replacement handle.

In use, the arms of the plate straddle the mid-portion (22) of the head and the holes (32) register with the holes from which the original cap screws (14) have been removed. The spacers serve to dispose the plate substantially at the level of the remaining handle and thus necessitate the use of longer cap screws (40) to secure the plate, head and body together. The handle is completed by the provision of a pair of steel one-half-tubes (42), each of a length on the order of the length of the plate leg (28). Each half-tube is, of course, semi-circular in section, or substantially so, and the two halves are secured by welding to opposite faces of the leg (see FIG. 5) and the assembly (plate and half-tubes) is appropriately ground to remove burrs and the like, thus affording a replacement handle that substantially matches the remaining handle.

The legs so are shaped to accurately fit the top of the jackhammer, and, for this purpose, the underside edges of the legs are suitably beveled as at (44).

I claim:

1. A replacement handle for substitution for a handle broken off from a flat top of a jackhammer, comprising a one-piece, Y-shaped element of rigid plate-like material having opposite flat faces lying respectively in parallel planes and having a leg and a pair of arms coplanar with the leg for overlying the flat top of a jackhammer, each arm having an aperture therethrough on an axis normal to the planes of the element faces for receiving fasteners engageable with the flat top of a jackhammer.

2. A replacement handle as in claim 1, including a pair of tubular spacers rigidly secured respectively to the arms in respective coaxiality with the apertures.

3. A replacement handle as in claim 2, in which each arm has a pair of apertures and there are two pairs of spacers, one spacer being coaxial with each aperture.

4. A replacement handle as in claim 3, including gussets rigidly joining a portion of the leg to the two spacers closer to the leg.

5. A replacement handle as in claim 4 in which the element is steel and the spacers are welded to the arms and the gussets are welded to the element and to the spacers closer to the leg.

6. A replacement handle as in claim 1, including hand-grip means carried by the leg.

7. A replacement handle as in claim 6, in which the grip means includes a pair of complementary arcuate members secured respectively to the opposite faces of the element leg and together forming a grip of substantially circular section with the leg as a diameter.

* * * * *